US005697769A

United States Patent [19]

Kobman et al.

[11] Patent Number: 5,697,769

[45] Date of Patent: Dec. 16, 1997

[54] FUEL PUMP OUTLET ASSEMBLY

[75] Inventors: Richard L. Kobman, Cass City; Edward J. Talaski, Caro, both of Mich.

[73] Assignee: Walbro Corporation, Cass City, Mich.

[21] Appl. No.: 533,379

[22] Filed: Sep. 25, 1995

[51] Int. Cl.[6] ..... F04B 17/03

[52] U.S. Cl. ..... 417/410.1; 417/410.3

[58] Field of Search ..... 417/366, 410.1, 417/410.3, 410.4, 422; 310/71, 87, 88

[56] References Cited

U.S. PATENT DOCUMENTS

| | | | |
|---|---|---|---|
| 4,447,192 | 5/1984 | Tuckey | 417/366 |
| 4,789,308 | 12/1988 | Tuckey | 417/44 |
| 4,834,623 | 5/1989 | Triolo et al. | 417/366 |
| 5,343,103 | 8/1994 | Aoki et al. | 310/87 |
| 5,554,010 | 9/1996 | Schoedl et al. | 310/71 |
| 5,593,287 | 1/1997 | Sadakata et al. | 417/410.4 |

FOREIGN PATENT DOCUMENTS

| | | |
|---|---|---|
| 6-205568 | 4/1987 | Japan . |
| 63-272994 | 4/1987 | Japan . |

*Primary Examiner*—Timothy Thorpe
*Assistant Examiner*—Peter G. Korytnyk
*Attorney, Agent, or Firm*—Barnes, Kisselle, Raisch, Choate, Whittemore & Hulbert

[57] ABSTRACT

A self-contained electric fuel pump having a d.c. motor with an armature having a commutator plate. An outlet end assembly has an inner cover and an outer cover. The inner cover is provided with brushes which contact the commutator plate. Electrically conductive pins mounted on the inner cover are electrically connected to the brushes. The outer cover is disposed over the inner cover and has electric terminals for connection to a source of d.c. current. The outer cover has choke coils connected to the terminals and electrically conductive tabs connected to the choke coils. When the outer cover is assembled on the inner cover, the tabs engage the pins to complete an electric circuit to the brushes.

14 Claims, 2 Drawing Sheets

FUEL PUMP OUTLET ASSEMBLY

FIELD OF THE INVENTION

This invention relates generally to fuel pumps for gasoline engines, and more particularly to an electric fuel pump outlet assembly.

BACKGROUND OF THE INVENTION

The outlet assembly of an electric fuel pump typically has brushes which deliver electric power to the armature of an electric motor. Electrical terminals on the outlet assembly must be wired to the brushes and it is desired to accomplish this as expeditiously as possible without the need for welding or other time consuming operations.

SUMMARY OF THE INVENTION

According to the present invention, the outlet assembly for the fuel pump has an inner cover and an outer cover. The brushes are supported on the inner cover. Shunt wires from the brushes lead to studs preferably located in sockets in the inner cover. Electrical terminals are carried by the outer cover for connection to a source of d.c. power. The circuitry from the electric terminals preferably includes tabs which are pressed into electrical contact with the studs when the outer cover is assembled on the inner cover. No welding is required at assembly. A "blind" assembly of the outer cover on the inner cover is possible and the brush springs may be installed after the covers are assembled.

One object of this invention is to provide a fuel pump outlet assembly having the foregoing features and capabilities.

Other objects are to provide a fuel pump which is composed of a relatively few simple parts, eliminates welding during assembly, provides an electrical connection which does not deteriorate in use, is rugged and durable in use, and is capable of relatively inexpensive manufacture and assembly.

BRIEF DESCRIPTION OF THE DRAWINGS

These and other objects, features and advantages of this invention will become more apparent as the following detailed description of the best mode proceeds, especially when considered with the accompanying drawings wherein.

DETAILED DESCRIPTION

Figure 3:
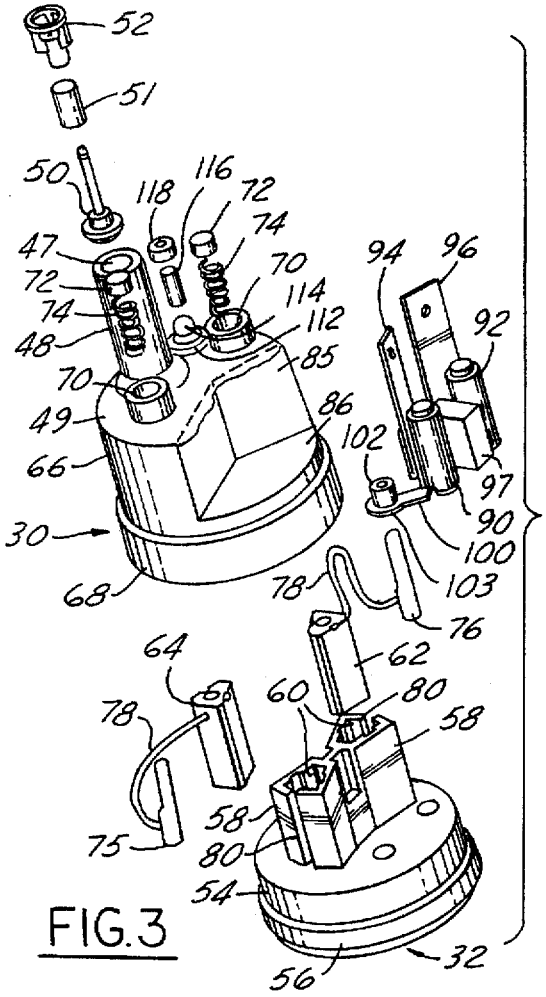
FIG. 3 is an exploded perspective view of the outlet assembly.
Figure 1:
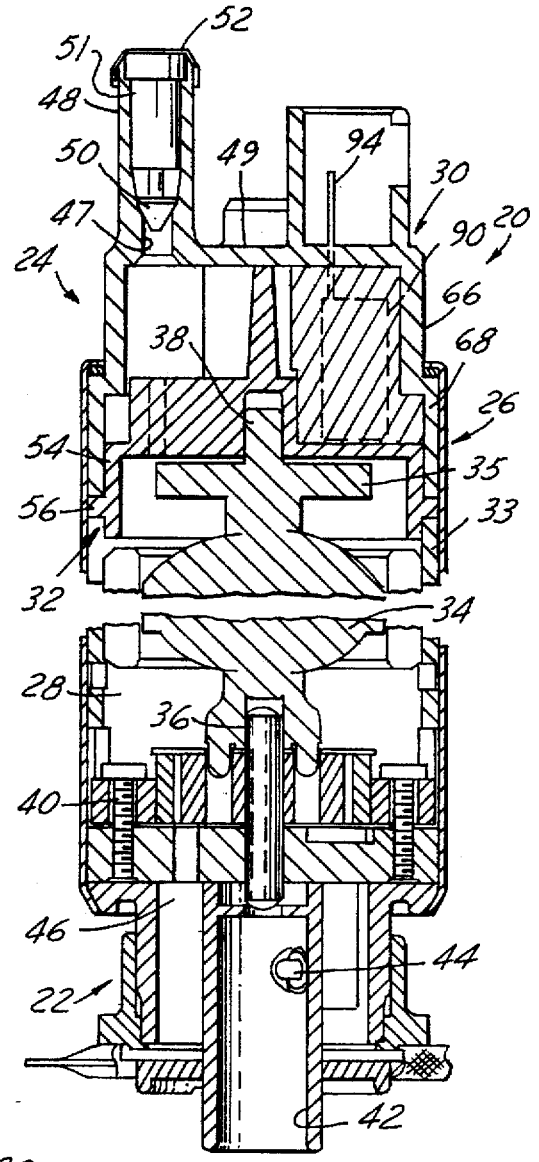
FIG. 1 is a longitudinal sectional view of a fuel pump embodying the invention, taken on the line 1—1 in FIG. 2.
Figure 4:
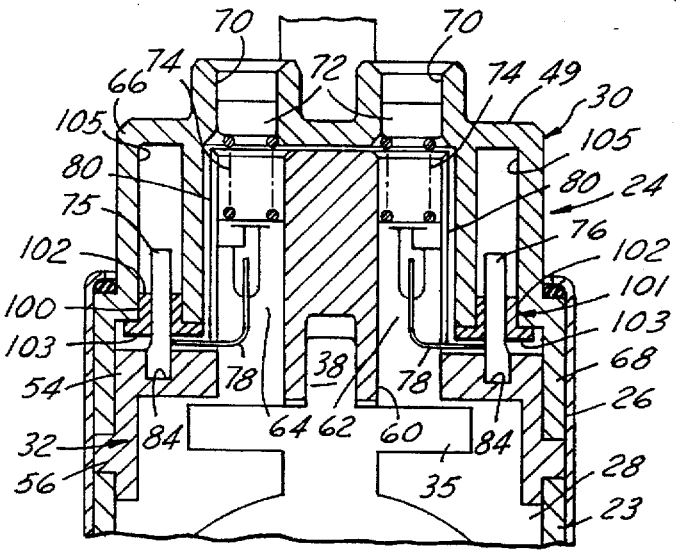
FIG. 4 is a fragmentary sectional view taken on the line 4—4 in FIG. 2.
Figure 2:
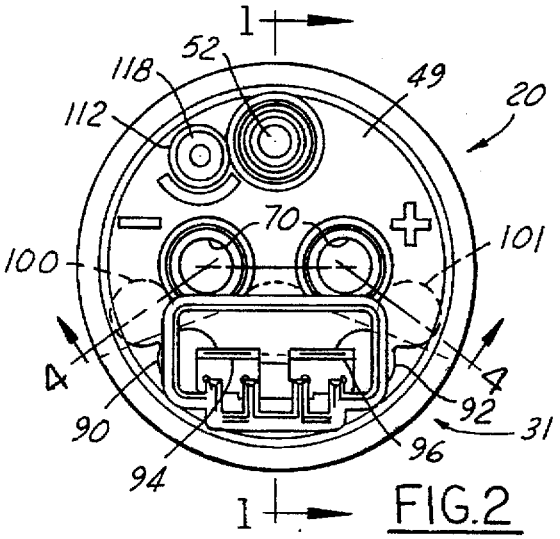
FIG. 2 is an end view of the fuel pump as viewed from above in FIG. 1.
Figure 7:
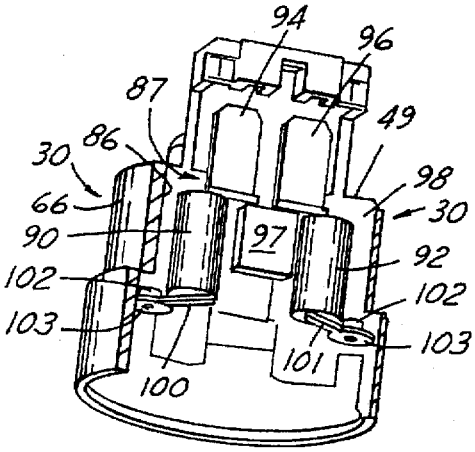
FIG. 7 is a view similar to FIG. 5 but in perspective.
Figure 5:
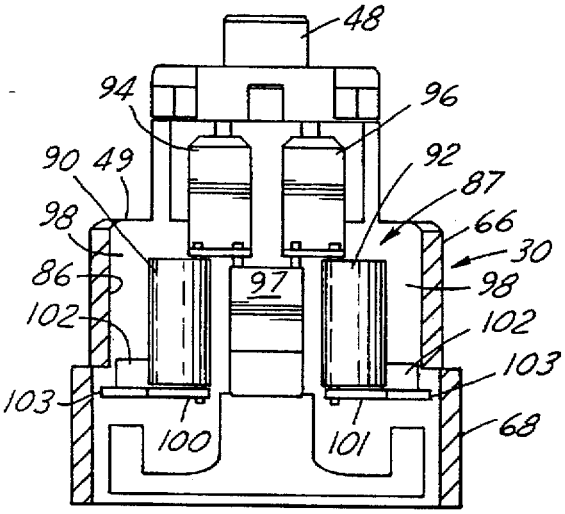
FIG. 5 is a view of the outer cover of the outlet assembly in longitudinal section.
Figure 8:
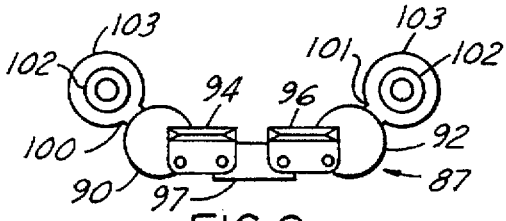
FIG. 8 is a view of the electric circuitry carried by the outer cover as seen from above.
Figure 9:
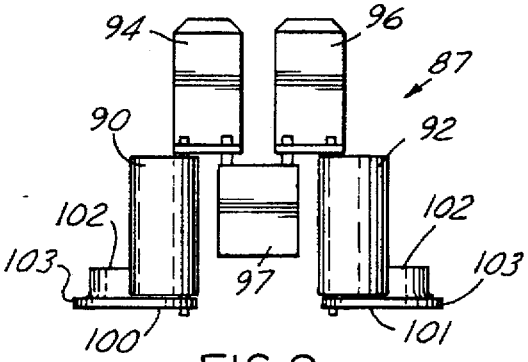
FIG. 9 is an elevational view of the electric circuitry shown in FIG. 8.
Figure 6:
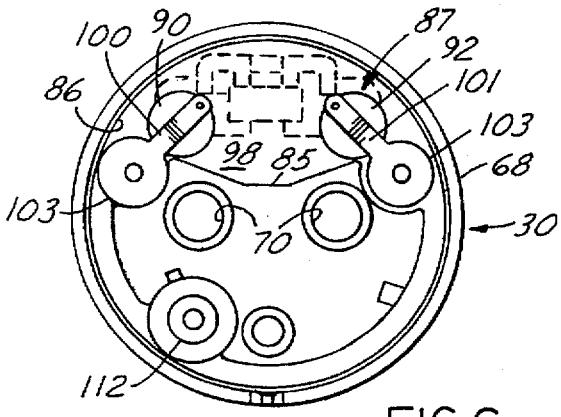
FIG. 6 is a bottom view of the outer cover.
Figure 10:
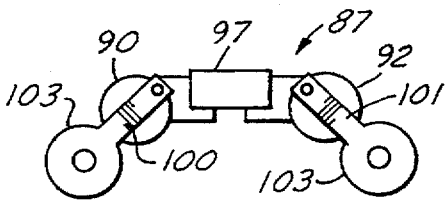
FIG. 10 is a bottom view of the electric circuitry shown in FIGS. 8 and 9.

Referring now more particularly to the drawings, the electric fuel pump 20 comprises coaxially spaced inlet and outlet end assemblies 22 and 24 interconnected by an elongated cylindrical casing 26 to provide a hollow pump housing 28. The outlet end assembly comprises an outer cover 30 and an inner cover 32.

A d.c. motor has a permanent magnet stator 33 mounted within casing 26 surrounding an armature 34 which has electric windings connected to a commutator plate 35. The armature 34 is journalled for rotation within housing 28 by a shaft 36 and a stub shaft extension 38 through the commutator plate 35. Armature 34 is coupled to a vane or gear rotor system 40 for pumping fuel from the inlet 46 into the housing 28 and then out through outlet 47 in the outer cover of the outlet end assembly 24 to the engine (not shown). The outlet 47 is formed in a tubular extension 48 of the outer wall 49 of the outer cover 30. A check valve 50 in outlet 49 is yieldably seated by a spring 51. A retainer 152 presses the guide 52 against spring 51 which presses against the check valve. The outer wall 49 of the outer cover 30 has a tubular extension 112 housing a relief valve 114 normally yieldably seated by a compression spring 116. A retainer 118 holds the spring 116 in contact with the relief valve 114.

The inner cover 32 has a cylindrical base 54 formed with an integral, radially outwardly extending annular flange 56. The inner cover has a pair of laterally spaced, axially outwardly extending, parallel projections or guide ways 58 having internal open-ended passages 60 for slidably receiving the respective elongated brushes 62 and 64 with a generally trapezoid cross-section which contact the commutator plate 35.

The outer cover 30 is a hollow, cup-shaped member having a cylindrical side wall 66 substantially closed at the outer end by the end wall 49 and open at the inner end. The skirt 68 at the open end fits over the base 54 of the inner cover 32 and abuts the flange 56 of the inner cover. The outer cover thus encloses and protects the ways 58 on the inner cover and the brushes 62,64 therewithin.

The outer wall 49 of the outer cover 30 has spaced apart cylindrical openings 70 which overlie the respective passages 60 in ways 58 of the inner cover when the outer cover is secured thereon in proper registration. Retainers 72 pressed into the openings 70 compress springs 74 which bear on brushes 62,64 and urge the brushes into mechanical and electrical contact with the commutator plate 35.

The brushes 62,64 are respectively connected to electrically conductive pins or studs 75 and 76 by electrical conductors or shunt wires 78 which extend through slots 80 in the side walls of the guide ways 58. The inner ends of pins 75,76 extend into sockets 84 in the inner cover and the outer ends project outwardly into the space within the outer cover.

The inside of the outer cover 30 has a wall 85 which extends inwardly from the outer wall 49 toward the inner end thereof. The side wall 66 and outer wall 49 of the outer cover cooperate with wall 85 in defining a compartment 86 for electrical circuitry 87 adapted to transmit electric current to pins 75,76 and brushes 62,64. The circuitry 87 comprises a pair of laterally spaced-apart elongated, cylindrical choke coils 90 and 92 extending lengthwise of the pump. Extending from the outer ends of the choke coils through the outer end wall 49 of the outer cover are electrical terminals 94 and 96 electrically connected to the coils such as by soldering. A capacitor 97 is electrically connected such as by soldering between the terminals 94,96 and hence across the coils 90,92. The coils and capacitor suppress radio frequency interference (RFI). Preferably, the choke coils are molded in a body 98 of a suitable plastic material filling compartment 86.

Electrically conductive tabs 100 and 101 have arms which extend across and are connected such as by soldering to the exposed inner ends of the choke coils. Each tab has a tubular member 102 at the outer end of the arm with a radially outwardly extending flange 103 around each tubular member 102. The tubular members are secured within bores 105 in the outer cover 30 with their flanges 103 abutting surfaces of the cover at the ends of the bores. The tubular members are in effect flanged eyelets and in assembly are pressed with an interference fit over the outer ends of the pins 75,76 to provide excellent electrical connection without any welding, soldering or the use of a threaded connector such as a nut and bolt. Preferably, the ends of the pins 75,76 are tapered to insure an excellent electrical and mechanical connection of the press fitted tubular members and pins.

During assembly of the outer and inner covers, initial alignment is achieved by projections 58 on inner cover 32 engaging into inner surface features of outer cover 30. These mating surfaces allow a defined engagement which is sufficient to lead the pins 75,76 into the eyelets 100,101 subsequent to the initial engagement.

When the electrical terminals 94 and 96 are plugged into a source of direct current, the current is delivered through the choke coils 90,92, the tabs or eyelets 100,101, the pins or studs 75,76, the electrical conductors 78, and the brushes 62,64 to the commutator plate 35 to drive the armature of the motor and pump fuel.

We claim:

1. An electric fuel pump comprising a pair of coaxially spaced inlet and outlet end assemblies and a casing joining said end assemblies to form a pump housing, a fuel inlet in said inlet end assembly and a fuel outlet in said outlet end assembly, a d.c. motor including an armature journalled for rotation within said housing and having a commutator plate, first and second brushes in electrical and mechanical contact with said commutator plate, a pump coupled to said armature for pumping fuel through said housing from said inlet to said outlet, and characterized by:

said outlet end assembly having an inner cover and a separate outer cover received over said inner cover, said first and second brushes being mounted on said inner cover, first and second electrical contact pins mounted on said inner cover for delivering d.c. current to said brushes, electrical conductors leading from said contact pins to said respective brushes, first and second electrical contact tabs mounted on said outer cover and engaging said respective first and second contact pins, first and second electrical terminals mounted on said outer cover and adapted to be connected to a source of direct current, and circuitry carried by said outer cover and electrically connecting said first and second terminals to said respective first and second tabs.

2. The electric fuel pump as defined in claim 1, wherein said circuitry includes choke coils affixed to said outer cover.

3. The electric fuel pump as defined in claim 2, wherein said tabs are secured to said choke coils.

4. The electric fuel pump as defined in claim 1, wherein said tabs are formed with apertures, and said pins extend through said apertures when in engagement with said tabs as aforesaid.

5. The electric fuel pump as defined in claim 4 wherein said pins have an interference fit with said tabs when received in said apertures.

6. The electric fuel pump as defined in claim 5 wherein at least the portion of each said pin received in said aperture is tapered.

7. The electric fuel pump as defined in claim 1, wherein said outer cover is generally cup-shaped and has means forming a compartment therewithin, a body of plastic substantially filling said compartment, and said circuitry includes choke coils embedded in said body of plastic.

8. The electric fuel pump as defined in claim 7, wherein said tabs are secured to said choke coils.

9. The electric fuel pump as defined in claim 8, wherein said tabs are formed with apertures, and said pins extend through said apertures when in engagement with said tabs as aforesaid.

10. The electric fuel pump as defined in claim 9 wherein said pins have an interference fit with said tabs when received in said apertures.

11. The electric fuel pump as defined in claim 10 wherein at least the portion of each said pin received in said aperture is tapered.

12. The electric fuel pump as defined in claim 7, wherein said pins each have an inner end extending into a socket in a surface of said inner cover and an outer end extending into said outer cover, said tabs are in the form of arms secured to said respective choke coils, each of said arms having an outer end formed with a tubular member, said tubular members sleeved over the outer ends of said respective pins.

13. The electric fuel pump as defined in claim 12, wherein said pins are tapered and have an interference fit with the tubular members.

14. The electric fuel pump of claim 1 wherein said circuitry comprises a pair of choke coils each electrically connected to one brush and a capacitor electrically connected across said pair of coils.

* * * * *